US011414877B1

(12) United States Patent
Rodriguez

(10) Patent No.: US 11,414,877 B1
(45) Date of Patent: Aug. 16, 2022

(54) VIBRATING DEVICE FOR SMOOTHING CEMENT WITH DIRECTION SENSOR

(71) Applicant: Mauricio Ortega Rodriguez, Boise, ID (US)

(72) Inventor: Mauricio Ortega Rodriguez, Boise, ID (US)

( * ) Notice: Subject to any disclaimer, the term of this patent is extended or adjusted under 35 U.S.C. 154(b) by 0 days.

(21) Appl. No.: 17/548,122

(22) Filed: Dec. 10, 2021

(51) Int. Cl.
*E04F 21/24* (2006.01)
*E01C 19/40* (2006.01)

(52) U.S. Cl.
CPC ..... *E04F 21/242* (2013.01); *E01C 19/402* (2013.01); *E04F 21/244* (2013.01)

(58) Field of Classification Search
CPC ..... E04F 21/242; E04F 21/244; E01C 19/402
USPC ..... 404/84.05–118; 15/235.4
See application file for complete search history.

(56) References Cited

U.S. PATENT DOCUMENTS 2,999,261 A 9/1961 Lapham
3,375,766 A * 4/1968 Zochil ..... E04F 21/245 404/112
3,683,761 A * 8/1972 Babic ..... E04F 21/245 404/112
4,859,115 A * 8/1989 Morrison ..... E04F 21/245 404/112
4,925,341 A * 5/1990 Neal ..... E04F 21/245 404/112
5,837,298 A 11/1998 Face, Jr. et al.
6,089,787 A 7/2000 Allen et al.
6,139,217 A 10/2000 Reuter
6,419,419 B1 * 7/2002 Kelsay, III ..... E04F 21/248 404/112
6,582,154 B1 * 6/2003 Updyke ..... E04F 21/241 404/118
6,923,595 B1 8/2005 Chek
6,981,819 B1 1/2006 Suckow et al.
7,059,801 B2 * 6/2006 Snyder ..... E04F 21/248 404/112
7,255,513 B2 * 8/2007 Lampley ..... E04F 21/245 404/112
7,686,538 B2 3/2010 Lutz et al.
8,221,027 B2 7/2012 Lura
8,439,600 B2 5/2013 Brening
(Continued)

OTHER PUBLICATIONS

"Rattle Stick VBA1 Dual Fuel Float Vibrator," www.rattlestick.net. https://www.rattlestick.net/product-page/rattle-stick-vba1-float-vibrator [Date accessed: May 17, 2021].

*Primary Examiner* — Raymond W Addie
(74) *Attorney, Agent, or Firm* — Binita J. Singh; Bold IP, PLLC

(57) ABSTRACT

A vibrating device includes a housing with a first and second cases that are connected to a mounting device and are connected to each other with a bridge tube. The mounting plate with the connected housing is removably connected to a blade of a cement smoothing device where the first and second cases are positioned on either side of a handle of the blade. The housing contains one or more motors to evenly impart a vibration to the blade. The housing also contains one or more sensor assemblies which are electrically connected to the one or more motors to selectively engage or disengage a circuit to power or not power the one or more motors. The one or more sensor assemblies are arranged to detect a tilt of the vibrating device to engage or disengage the power.

22 Claims, 12 Drawing Sheets

(56) References Cited

U.S. PATENT DOCUMENTS

| | | | | |
|---|---|---|---|---|
| 9,719,215 | B2 | 8/2017 | Mikowychok | |
| 10,326,331 | B2 | 6/2019 | Mikowychok | |
| 10,349,902 | B2 | 7/2019 | Girouard | |
| 10,895,045 | B2 | 1/2021 | Kangas | |
| 10,968,574 | B2 | 4/2021 | Mikowychok | |
| 2005/0036837 | A1 | 2/2005 | Marshall | |
| 2012/0183351 | A1 | 7/2012 | Brening | |
| 2016/0138282 | A1* | 5/2016 | Pereyra | E04F 21/241 15/235.8 |
| 2018/0327891 | A1 | 11/2018 | Baratta et al. | |
| 2021/0062437 | A1* | 3/2021 | Mikowychok | E01C 19/38 |

* cited by examiner

VIBRATING DEVICE FOR SMOOTHING CEMENT WITH DIRECTION SENSOR

FIELD OF THE INVENTION

The overall field of this invention generally pertains to concrete finishing and more specifically to vibrating devices for concrete finishing tools.

BACKGROUND OF THE INVENTION

There are many tools that are involved in pouring concrete and can be used to get a desired concrete finish. After an amount of concrete is freshly poured, concrete finishing tools such as floats, jointers, screeds, and the like may be used to provide the desired finished surface. Generally, an operator moves a particular tool back and forth across the freshly poured concrete to provide the desired finish to a dried concrete pour.

The most basic forms of cement smoothing devices used to smooth a freshly poured concrete may be a long handle float. One such example is a bull float. Generally, the long handle floats are wide-bladed tools which are fixed to long handles and are used to level ridges, fill voids, and smooth surfaces. Using the long handle, the wide-bladed tools are pulled and pushed across large areas of concrete. Vibrating devices for concrete finishing tools have been regarded as being useful and more efficient in creating a smooth surface. Vibrating devices that are a part of the wide-bladed tool may be placed in a handle or on the blade itself. However, the vibrating tool that is attachable is installed on a more permanent basis where the vibrating device is connected via screws or is manufactured as a part of the wide-bladed tool. These vibrating tools do not provide an option where the vibrating tool is removably attachable to a cement smoothing tool without the need to drill into the tool. Further these vibrating tools are not adaptable to be fitted onto different sized blades where one vibrating device may be used across different sized blades of varied cement smoothing devices.

Thus, there remains a need for a vibrating device for a cement smoothing device that is self-contained, portable, and removably attachable to different concrete finishing tool blades. Additionally, there remains a need for a vibrating device for a cement smoothing device that is removably attachable to the blade without any drilling. Additionally, there remains a need for a vibrating device for a cement smoothing device where the vibrating device automatically shuts off as an operator moves the tool backward to more efficiently smooth the cream that has risen to the top from the vibration. Moreover, there remains a need for a vibrating device for a cement smoothing device with a variable speed controller with a digital read out for an operator to visibly see and determine the speed a motor should operate.

SUMMARY OF THE INVENTION

In accordance with the present invention, several embodiments of a novel and useful vibrating device for a cement smoothing device are provided.

In a non-limiting embodiment, a vibrating device for use with a cement smoothing device is configured to cause vibration of the cement smoothing device to efficiently smooth and fill any voids on a fresh concrete pour. The vibrating device is configured to be attachable to a blade of a concrete finishing tool and preferably be positioned on the blade on either side of a handle of the concrete finishing tool such as to evenly provide weight and vibration to the concrete finishing tool. The vibrating device has one or more enclosures that comprise of one or more motors, one or more sensors, one or more batteries, a variable speed control, a speed display, and one or more relays. The vibrating device has an adjustable mounting plate allowing the vibrating device to be securely mountable to different sized blades for cement smoothing devices. Additionally, the vibrating device may connect to one or more adaptors to mount the vibrating device onto cement smoothing devices having blade designs and dimensions that do not permit a secure fit of the mounting plate onto their blades.

Actuation of the one or more motors within the vibrating device causes the vibrating device to vibrate, which then causes the blade of the cement smoothing device the vibration device is mounted onto to vibrate. The one or more sensors within the vibrating device relay to the motor to turn off and on depending on the direction. As the user moves the concrete finishing device forward over the concrete pour, the motor is on, as the user reverses direction and moves the finishing device backward, the motor shuts off, and as the user resumes the forward direction the motor turns back on. In addition, the vibrating device may also be controlled by a remote control wherein the remote control may be used to turn the motor on and off and additionally control the speed of the motor. Moreover, the speed display on the vibrating device and on the remote control would provide visual indication of the speed.

The presently disclosed vibrating device for a cement smoothing device is further described in the attached drawings and detailed description below. Other aspects and advantages of the invention will be apparent from the following description and the appended claims.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF THE INVENTION

Figure 1:
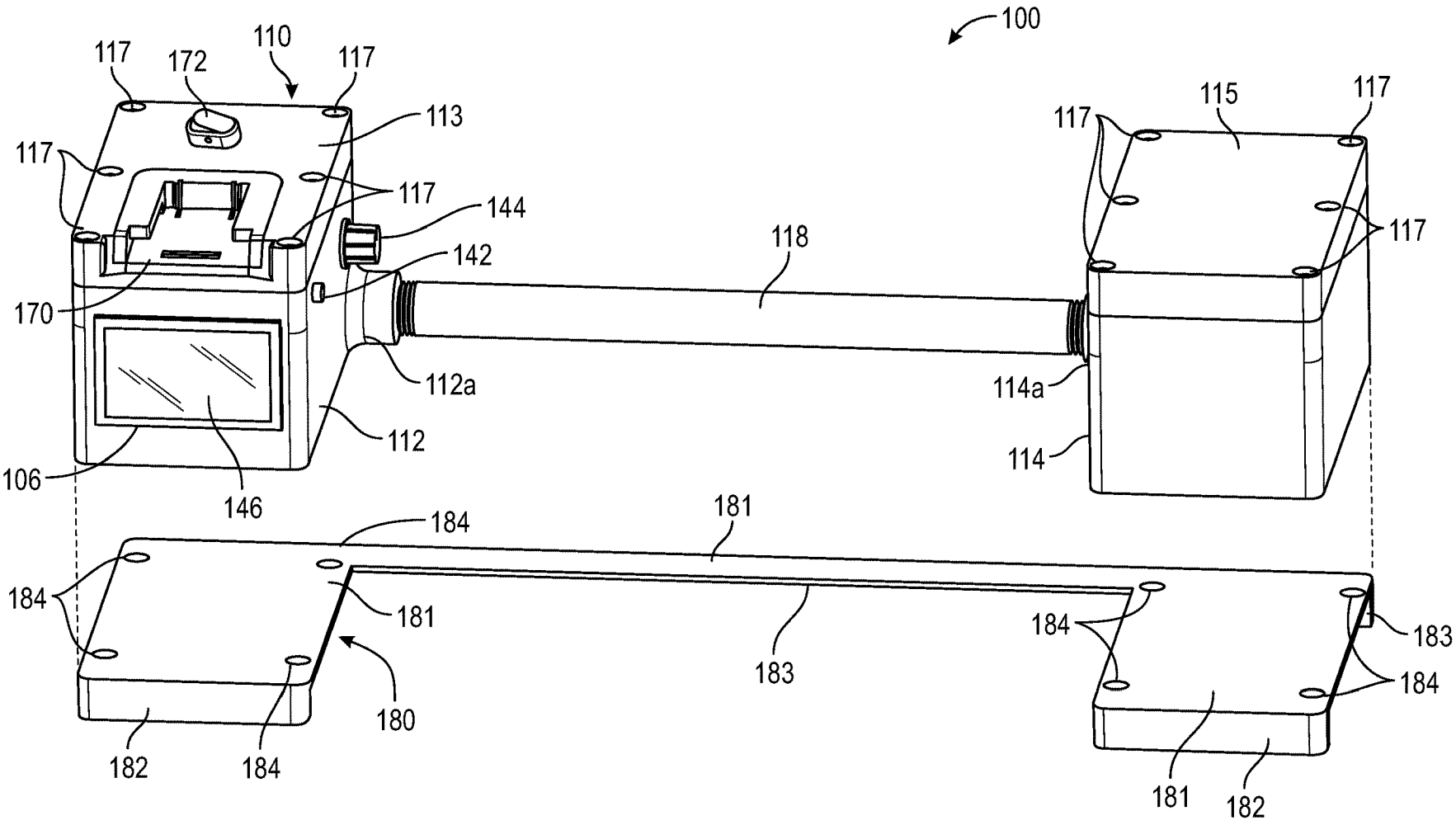
FIG. 1 is an illustration depicting a front perspective view of a vibrating device depicting a housing and a mounting plate not attached together, and that may be used with a cement smoothing device.

In the Summary above and in this Detailed Description, and the claims below, and in the accompanying drawings, reference may be made to particular features of the invention. It may be understood that the disclosure of the invention in this specification includes all possible combinations of such particular features. For example, where a particular feature may be disclosed in the context of a particular aspect or embodiment of the invention, or a particular claim, that feature can also be used, to the extent possible, in combination with and/or in the context of other particular aspects and embodiments of the invention, and in the invention generally.

Where reference may be made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" may be used herein to mean "serving as an example, instance, or illustration." Any aspect described in this document as "exemplary" may not be necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The present disclosure recognizes that using vibration for finishing concrete in contrast to finishing without vibration may reduce the amount of time required to finish. The use of vibration may also provide an improved finishing surface by efficiently bringing the cream to the top with the vibration and automatically shutting off the vibration in reverse to help smooth the cream that has come to the surface and improving the appearance of the finished concrete. In addition, a user of a cement smoothing device using the vibration device can simply remove the vibration device and mount on to another cement smoothing device and can easily do so with the mounting plate or using an adaptor.

Figure 2:
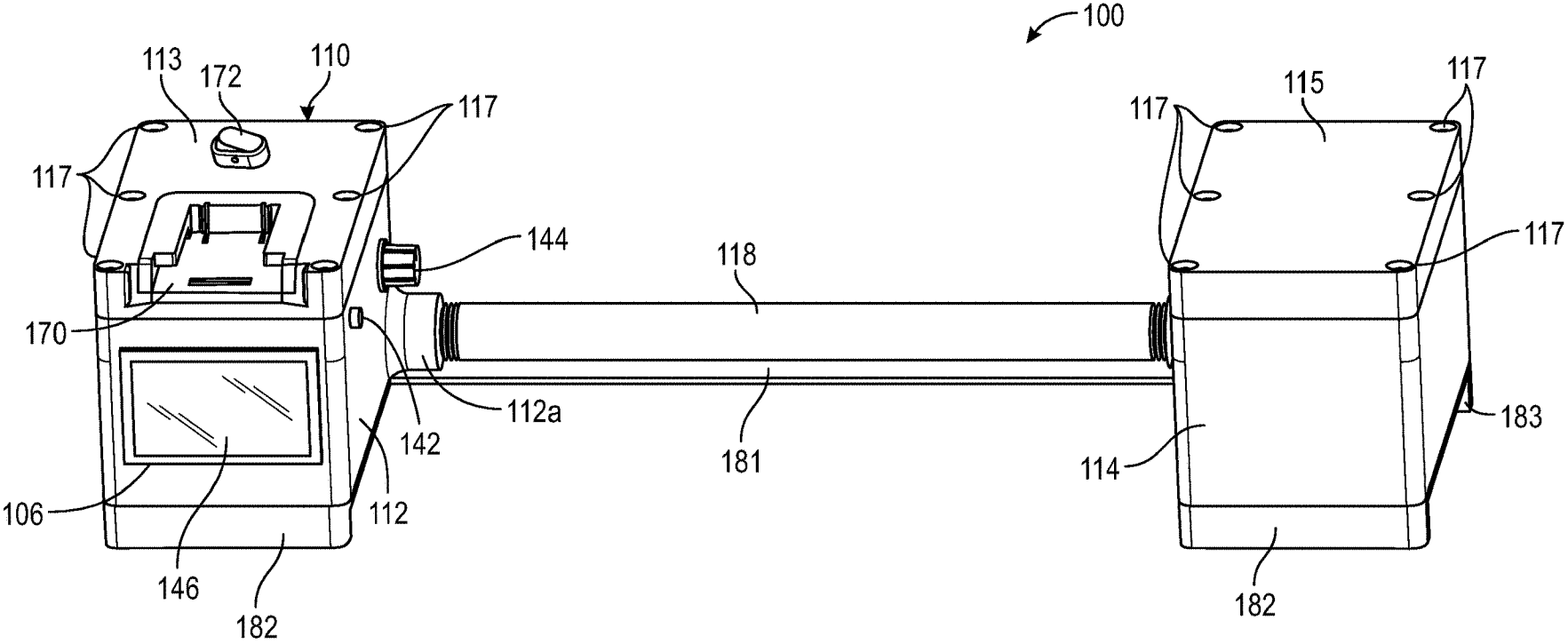
FIG. 2 is an illustration depicting a front perspective view of a vibrating device, depicting the housing attached to the mounting plate.
Figure 3:
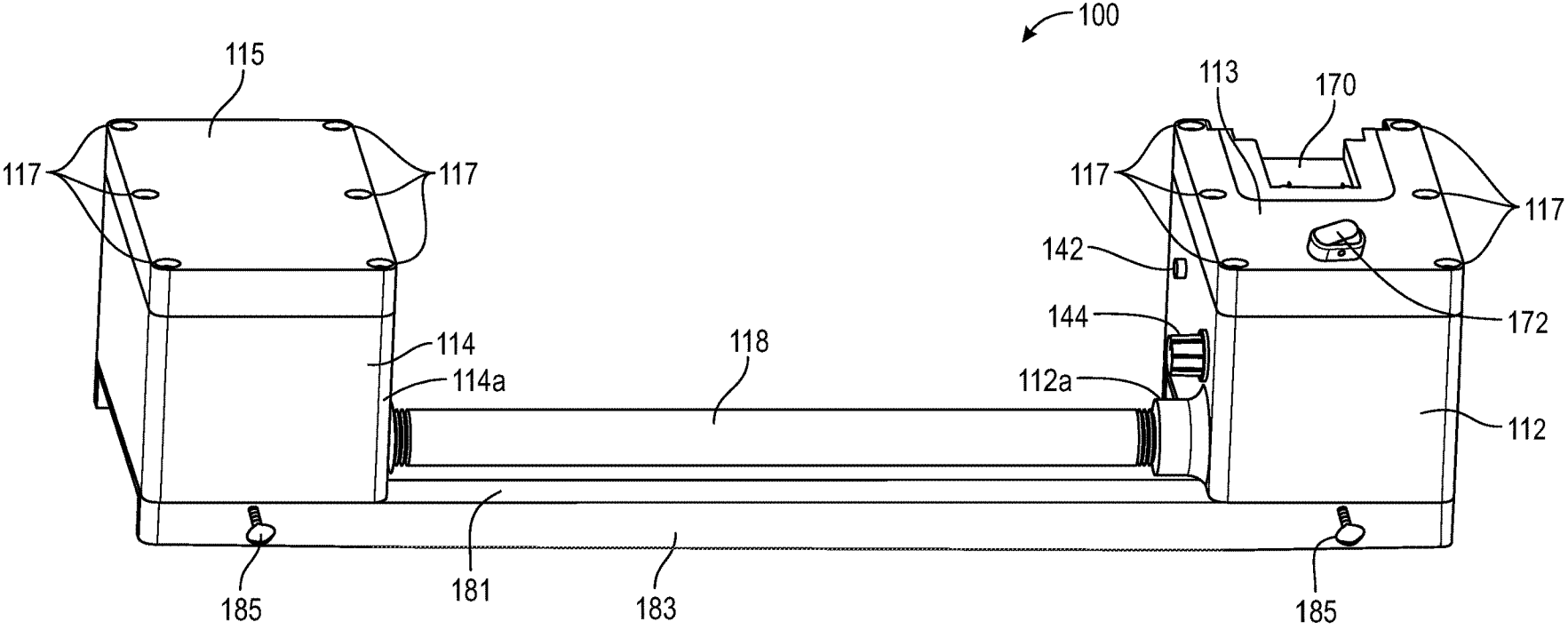
FIG. 3 is an illustration depicting a back perspective view of a vibrating device.
Figure 4:
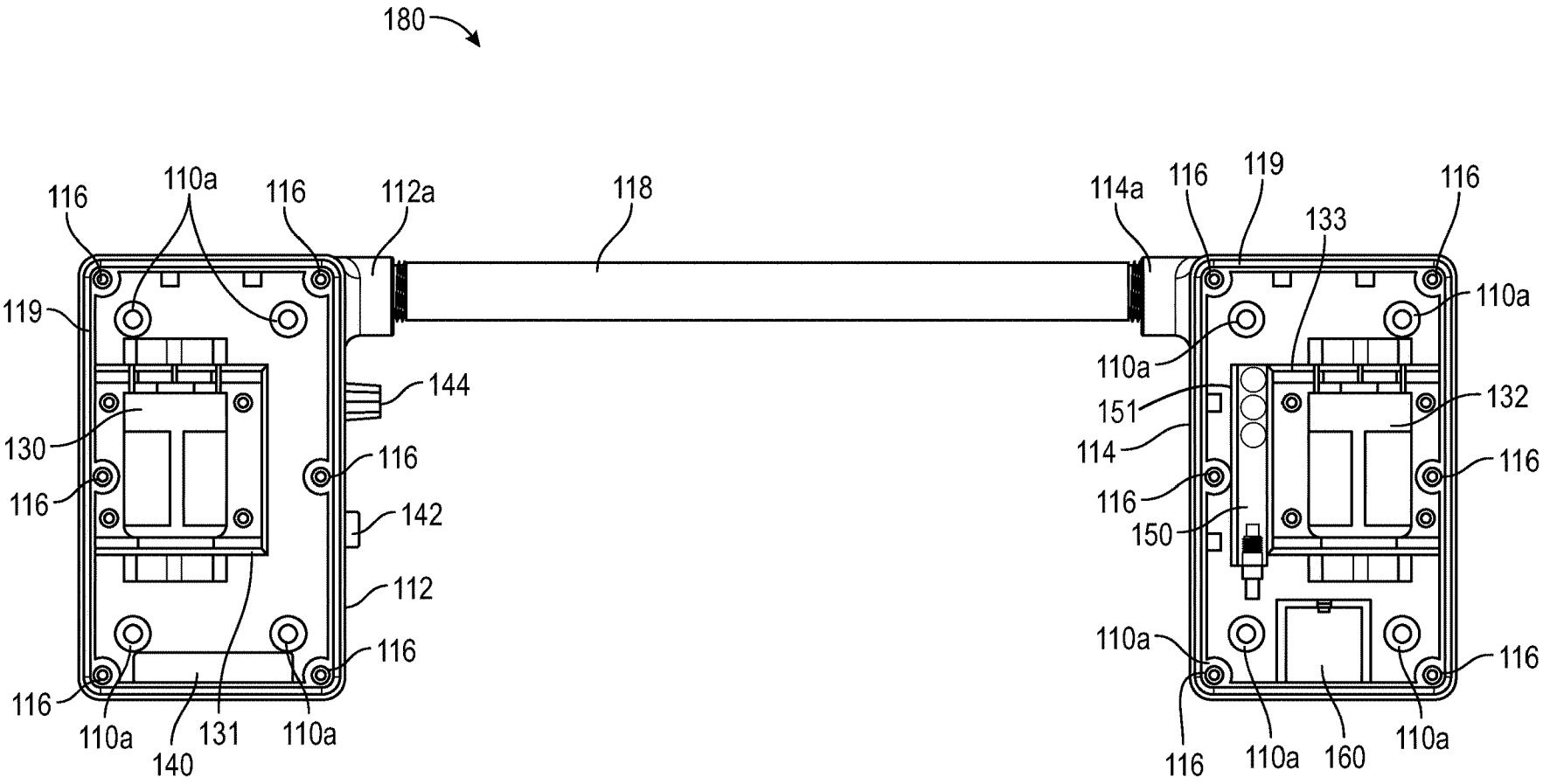
FIG. 4 is an illustration depicting a top view of an inside of a first case and a second case of a housing of the vibrating device.
Figure 5:
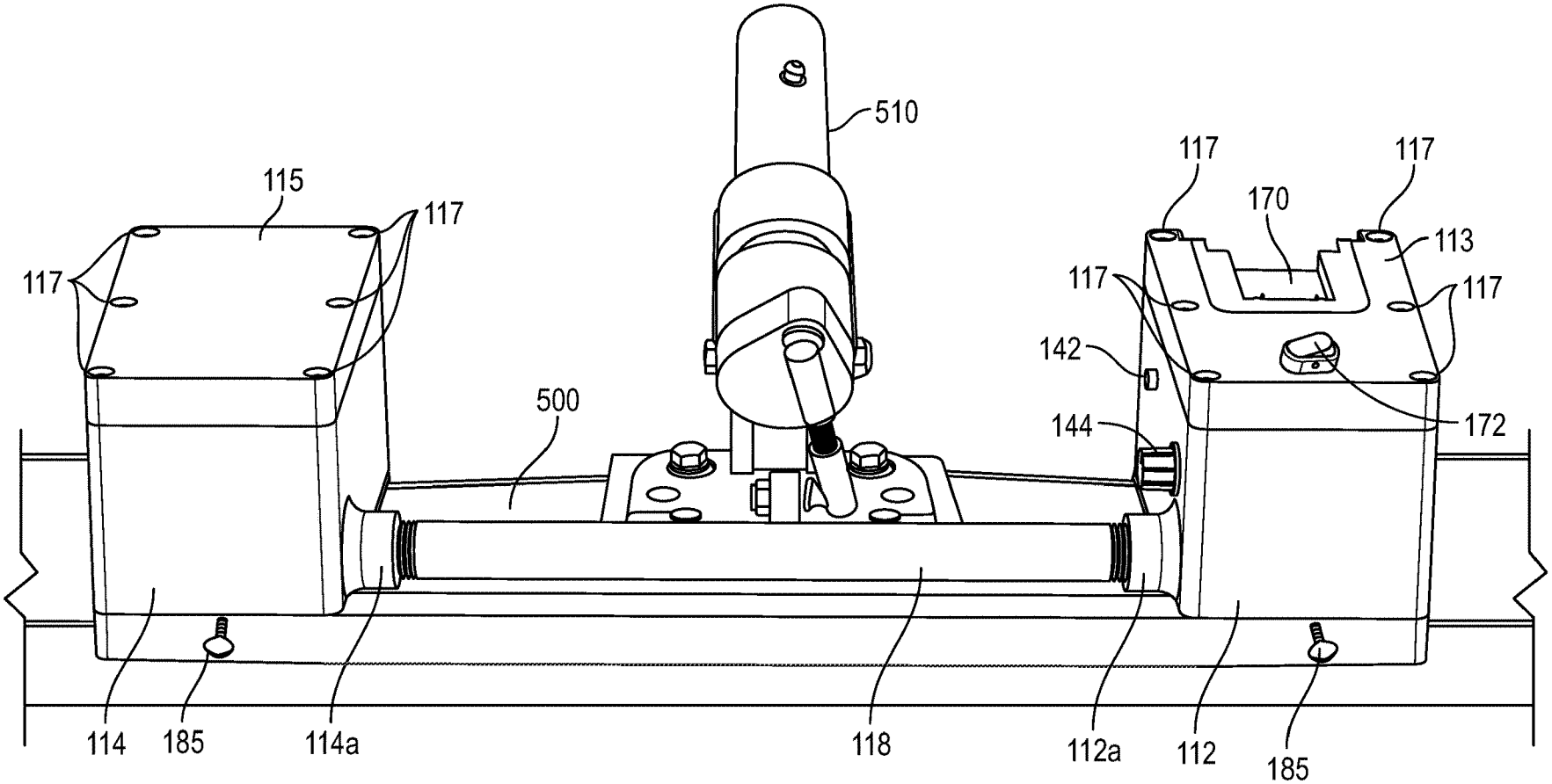
FIG. 5 is back perspective view of the vibrating device mounted onto a blade of a cement smoothing device.
Figure 6:
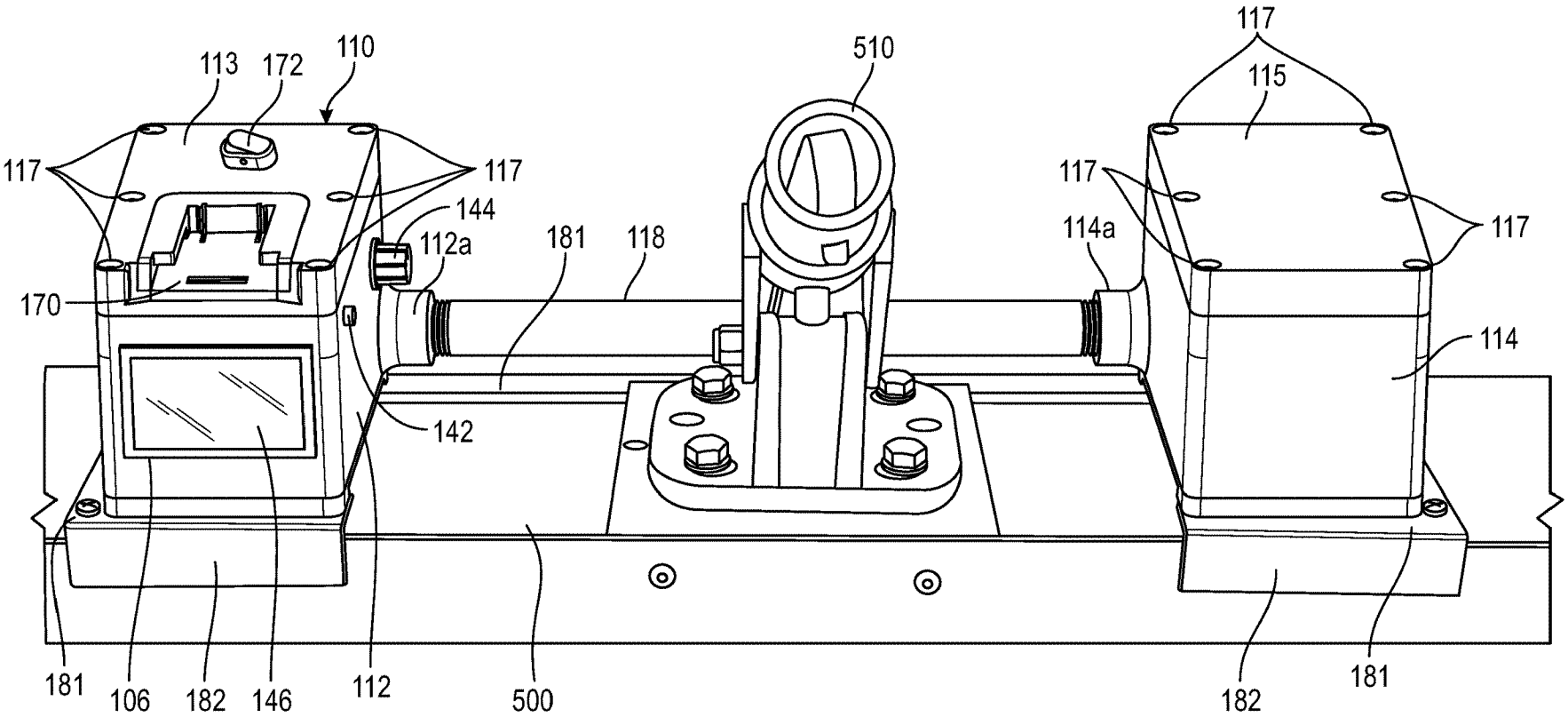
FIG. 6 is a front perspective view of the vibrating device mounted onto a blade of a cement smoothing device.

FIGS. 1-6 illustrate a non-limiting embodiment of a vibrating device 100 which may be removably mounted to a blade 500 of a cement smoothing device. It is also to be understood that the vibrating device 100 may be mounted to a number of different types of concrete smoothing devices which can benefit from and achieve the desired results of a vibrating device when smoothing cement. FIG. 1 illustrates a front perspective view of the vibrating device 100 depicting a separated housing 110 an adjustable mounting plate 180. The vibrating device 100 comprises of the housing 110 which is coupled to the adjustable mounting plate 180 to position and mount the vibrating device 100 onto a cement smoothing device blade 500. FIGS. 2 and 3 illustrate a front perspective view and a back perspective view, respectively, of the vibrating device 100 with the housing 110 coupled to the mounting plate 180. FIG. 4 illustrates a top view of the inside of the housing 110 of the vibrating device 100. FIGS. 5 and 6 illustrate the vibrating device 100 mounted onto a blade 500 of a cement smoothing device from a back and a front, respectively.

As used herein, "front" describes a view of the vibrating device 100 as facing an operator during use mounted on the blade 500 of a cement smoothing device. As used herein, "back" describes a view of the vibrating device 100 as facing away from an operator during use mounted on the blade 500 of a cement smoothing device.

The housing 110 may comprise of one or more cases which are designed and purposed to house and contain one or more vibratory and one or more sensor elements (discussed below). In the embodiments shown in the Figures, the housing 110 comprises of two cases, a first case 112 and a second case 114. The housing further comprises of a bridge tube 118 which connects to and bridges the first case 112 and the second case 114. Each of the first case 112 and the second case 114 define an enclosure for containing some additional features of the vibrating device 100, which will be discussed below. Each of the first case 112 and the second case 114 may include a cover comprising a first cover 113 and a second cover 115, respectively. The first and second covers 113, 115, provide access into the first and second cases 112, 114, and to their respective vibratory and sensor components housed within. The first and second covers 113, 115 are preferably removable and connect to a top of the first case and second case 112, 114, respectively, to securely close the top. The first and second covers 113, 115 have holes 117 that correspond with holes 116 on the top of the first and second cases 112, 114 (see, FIG. 4 for holes 116). The first and second covers 113, 115 are securely connected to the first and second cases 112, 114, respectively, with fasteners (not shown) that fit into the holes 117, 116. The fasteners may include and not be limited to screws and bolts. Other types of fasteners known in the arts are also within this disclosure.

The first and second case 112, 114 connections with their respective first and second covers 113, 115, is preferably supported by a seal 119. As best seen in FIG. 4, the seal 119 extends around the top edges of the first and second case 112, 114. This ensures that the connection is a sealed connection and that any liquid or other debris does not enter the enclosures and fully protects the contents of the first and second case 112, 114. The vibrating device 100 is used to smooth cement that has just been poured and having a sealed connection ensures that none of the debris that can fall onto the housing does not enter the enclosed space. The seal 119 may be a gasket or any other type of seal known in the arts. The seal 119 may comprise of a groove with a gasket assembled within the groove during manufacturing or placed in the groove when placing the covers over the cases.

The first and second cases 112, 114 can be any shape, size, and depth as long as it provides adequate support and protection for the components contained within it. As seen in the Figures, the first and second cases 112, 114 have a substantially rectangular shape and may be made of any durable and strong material such as and not limited to aluminum, iron, or an alloy. The first and second covers 113, 115 correspond in shape and size to the first and second covers 112, 114 but with a relatively smaller depth than their corresponding cases. It is to be understood that the covers and the cases may include similar depths as long as the dimensions provide adequate support and protection for the components contained within the cases.

As seen in FIGS. 5 and 6, the vibrator device 100 is mounted to the blade 500 of a cement smoothing device. A handle 510 generally extends from a relative center of the blade 500. The vibratory device 100 is designed to impart equal and controlled vibration on either side of the handle 510. In the embodiment shown in the Figures, the vibrator device 100 comprises of the housing 110 which includes the first case 112 on a first side of the handle 510 and the second case 114 on a second side of the handle 510 such as to evenly distribute the vibration on the blade 500. The housing is also comprised of the bridge tube 118 which connects the first case 112 and the second case 114. The bridge tube 118 is essentially hollow and allows any wiring to be passed through between the first case 112 and the second case 114. The bridge tube 118 is shown to have a circular cross-section, however, it is to be understood that any cross-sectional shape may be used, including, and not limited to, an oval cross-section, a square cross-section, a rectangular cross-section, a triangular cross-section, and a polygonal cross-section. The bridge tube 118 may also be fashioned from the same material as the first and second cases 112, 114.

The first case 112 and the second case 114 are relatively parallel to each other and each have a first connection port 112*a* and a second connection port 114*a* configured on a side of the first and second case 112, 114, respectively, that face each other. The first and second connection ports 112*a*, 114*a* are essentially openings into their respective first and second cases 112, 114 and are configured to connect to the bridge tube 118. An example may include the connection ports 112*a*, 114*a* configured with threads that matingly engage with threads on each end of the bridge tube 118. Other attachment means may include each end of the bridge tube 118 sliding into the connection ports 112*a*, 114*a* to make a removably secure connection. As seen in the Figures, the connection ports 112*a*, 114*a*, are defined as projecting outward from their respective first and second cases 112, 114. The outward projection of the connection ports 112*a*, 114*b* allows a better sealable port as a length of the connection ports 112*a*, 114*a*, may include the threads that the bridge tube matingly engages with. Additionally, the connection ports 112*a*, 114*a* extending outward also do not take up any space within the enclosed space of the first and second cases 112, 114. It is to be understood that the connection ports 112*a*, 114*a*, may be defined as not projecting outward, but may be flush with the surface on the first and second cases 112, 114, or alternatively project inward into the enclosed space.

The connection ports 112*a*, 114*a* and the bridge tube 118 are described as being configured as different elements which removably engage with each other to provide a sealable port for wiring to move between the first and second cases 112, 114. In this layout, the bridge tube may be removed from the connection ports 112*a*, 114*a*, and allow an operator to make any repairs that may be necessary that may require moving the wiring between the first and second cases 112, 114. Alternatively, the bridge tube 118 and the connection ports 112*a*, 114*a* may be molded as one-piece during manufacturing.

The vibrating device 100 also comprises of the mounting plate 180. The mounting plate 180 is shaped to be positioned on a top surface of the blade 500 of a concrete smoothing device. The mounting plate 180 allows the vibrating device 100 to be mounted to the blade 500 without drilling or screwing into the blade 500. The mounting plate 180 also allows the vibrating device 100 to be easily removable from the blade 500 and further does not cause any damage to the blade 500 of the concrete smoothing device. As best seen in FIGS. 1-3, the mounting plate 180 is a one-piece construction configured as a flat plate, corresponding with the size and shape of the housing 110. Thus, the mounting plate 180 may have a portion similar in size and shape to the first and second cases 112, 114 with an elongated piece connecting the two portions which is intended to correspond with and is parallel to the bridge piece 118 when the mounting plate 180 is connected to the housing 110. It is intended that the mounting plate 180 be of a similar size and shape to the housing 110 so that the footprint of the vibrating device is not increased while still providing adequate support to securely mount onto the blade 500 of a concrete smoothing device.

The mounting plate 180 is configured as a flat plate onto which the housing 110 is attached. In the embodiment shown, the mounting plate has a base plate 181, a front edge 182, and a back edge 183. The housing 110 is attached to the base plate 181 by any connectors or fasteners, which may include and not be limited to bolts and screws. As seen in FIGS. 1 and 4, the mounting plate has openings 184 on the base plate 181 and the first and second cases 112, 114 of the housing 110 have correspondingly positioned and spaced openings 110*a* so that the fasteners or connectors may be positioned through the openings 184, 110*a* to attach the housing 110 to the mounting plate 180. It is to be understood that the method of securing the housing 110 to the mounting plate 180 can be used as will be understood by those skilled in the arts. It is also to be understood that the housing 110 may be more permanently attached to the mounting plate, such as being welded onto the mounting plate 180 or the housing 110 and the mounting plate 180 may be constructed as one-piece.

As seen in FIGS. 1-3, the front edge 182 and the back edge 183 extend down and away from the base plate 181 parallel to each other and relatively perpendicular to the base plate 181 where the housing 110 may be attached to the mounting plate 180. The front edge 182 and the back edge 183 are relatively parallel to each other allowing the mounting plate 180 with the attached housing 110 to be placed onto the blade 500 of a cement smoothing device. The front edge 182 and the back edge 183 engage with one or more edges of the blade 500 with the base plate 181 resting on a top surface of the blade 500 and thus allowing the mounting plate 180 to preferably removably attach to the blade 500. The mounting plate 180 is mounted onto the top surface of the blade 500 without drilling or screwing into the blade 500. As seen in FIG. 3, the back edge 183 of the mounting plate accommodates one or more fasteners 185 that may be inserted through the back edge 183 and used to hand tighten the mounting plate onto the blade 500 of the cement smoothing device. The fastener 185 may include any type of screw that is capable of being tightened by the hand of an operator, such as and not limited to a thumb screw or a wing screw. The fastener 185 is intended to make small adjustments to allow the mounting plate to securely attach to the blade 500. An end of the fastener 185 abuts against the blade 500 and allows small adjustments to be made by securely pushing the end of the fastener 185 against the blade 500. It is to be understood that the front edge 182 of the mounting plate 180 may include the fastener 185, or both the front edge 182 and the back edge 183 may include a fastener 185, or the mounting plate 180 may not include a fastener.

The vibrating device 100 is for use with a concrete smoothing device and is configured to mount onto and cause vibration of the blade 500 of a concrete smoothing device. Further, the vibrating device 100 is configured to automatically stop the vibration when the blade 500 of the concrete smoothing device with the mounted vibrating device 100 is moved backward. Additionally, the vibrating device 100 is configured to automatically restart the vibration when the blade 500 of the concrete smoothing device with the mounted vibrating device 100 is moved forward.

The vibrating device 100 is generally configured to house and contain one or more motors (see, FIG. 4; a first motor 131, and a second motor 132), a speed controller 140, one or more sensor assemblies 150, and a relay 160. Further the vibrating device 100 is also configured to connect to a power source which may be referred to as a power dock 170. It is to be understood that the vibrating device may be configured with one or more power docks 170 which allows the vibratring device to connect to one or more power sources. Additionally, the vibrating device 100 is configured to include a power on/off switch 172, a speed on/off switch 142, a speed adjustment knob 144, and a speed display 146.

The first case 112 and the second case 114 preferably house a first motor 130 and a second motor 132, respectively. The first and second motor 130, 132 are each coupled to their respective first and second cases 112, 114. The first and second motors 130, 132, may be contained within their own motor housings 131, 133 respectively. The first and second motor 130, 132 are placed within their respective motor housing 131, 133, which are removably attached to the first and second cases 112, 114, respectively. The motor housings 131, 133 may be secured to the first and second cases 112, 114, respectively, by connectors or fasteners which can be placed on each side of the motor housings 131, 133. Actuation of the motors 130, 132 causes a vibration that is imparted through the housing 110 and the mounting plate 180 and is transferred to the blade 500 of a cement smoothing device. The vibration imparted to the blade 500 vibrates on the wet concrete to pull the cream to the top surface of the wet concrete and the first and second motors 130, 132 on either side of the handle 510 evenly impart the vibration to the blade 500 to provide a smooth and level concrete surface.

The vibrating device 100 is powered by an external power source that connects to the power dock 170. The power dock 170 may be a female socket configured onto the housing 110. The embodiment illustrated in the Figures shows the power dock 170 configured onto the first cover 113 that attaches on to the first case 112. The power source may be a battery (not shown) that is connected into the power dock 170 to provide the power necessary to power the first and second motors 130, 132 and the other components requiring the power. The battery may be a rechargeable battery that can be removably secured and electrically connected to the components of the vibrating device 100 requiring power to function. As shown in the Figures, the vibrating device 100 is comprised of one power dock 170 capable of connecting to one power source (i.e., battery). However, one or more power docks 170 can comprise the vibrating device, wherein each of the first cover 113 and the second cover 115 may be configured with the power dock 170 wherein the vibrating device 100 can connect to two power sources (i.e., two batteries). Alternatively, the power source, such as a battery, may be housed within the housing 110 either in the first case 112, or the second case 114, or in both. The power dock 170 connects the power source to the other components with wires or couplers.

The power dock 170 connects the power source directly to the power on/off switch 172 which connects the power source to the other components opening. The power on/off switch 172 turn the electrical circuit on and off, respectively. The on/off switch 172 may be configured anywhere on the housing 110 allowing the on/off switch 172 to be in electrical communication with the power source, such as a battery on the power dock 170. As shown in the Figures, the on/off switch 172 is integrated onto the first cover 112 which is also configured with the power dock 170 for a power source so they can be easily coupled to each other with wires or couplers or any other acceptable means.

The vibrating device 100 is also comprised of the speed controller 140 which is operatively connected to the speed on/off switch 142 and the speed adjustment knob 144. The speed controller 140 is also coupled to each of the first and second motors 130, 132 to vary the speed the first and second motors 130, 132 should operate at. The power is connected to the speed controller 140 through the on/off switch 172. The speed control 140 is contained within the housing 110, and as shown in the Figures, the speed controller 140 is contained within the first case 112. It is to be understood that the speed controller 140 may alternatively be contained within the second case 114. The speed controller 140 may be contained within a housing (not shown) or may be directly secured within the housing 110 of the vibrating device 100. It is also to be understood that the vibrating device 100 may not comprise of a speed controller 140 and be configured to power the one or more motors 130, 132 directly so as to have a constant speed.

The speed controller 140 includes the speed display 146 which provides a visual indication of the speed of the first and second motors 130, 132. The housing 110 may also include an opening, referred to as a speed display opening 106, on a front side of the first case 112 wherein the speed controller with the speed display 146 is placed against. The speed controller 140 is placed against the front side of the first case 112 within the housing 110 such that the speed display 146 is visible through the speed display opening 106. The speed display 146 would be facing in the direction of and visible to an operator while operating the cement smoothing device.

The speed controller 140 also includes the speed on/off switch 142 and the speed adjustment knob 144, which may be positioned on the housing 110 in proximity to the speed controller 140. In the Figures, the speed on/off switch 142 and the speed adjustment knob 144 are positioned on the first case 112. The speed on/off switch 142 and the speed adjustment knob 144 are coupled to the speed controller 140 by wires or couplers or may be wirelessly connected by a remote control (not shown) if the speed controller 140 has remote operation capability and components. It is to be understood that there can also be multiple speed controllers with their own speed on/off switch and adjustment knob, so that each of the first motor and the second motor is controlled by separate speed controllers and is independent of the other.

The vibrating device 100 is also comprised of one or more sensor assemblies 150 which may be coupled to the power relay 160 with wires or couplers (not shown). The power relay 160 is coupled to the first and second motors 130, 132 with wires or couplers (not shown). The one or more sensors 150 are essentially configured to allow and prevent current to flow to the first and second motors 130, 132. In continuing the flow of current, the one or more sensors 150 allow the first and second motors 130, 132, to operate and impart vibration to the blade 500. In preventing current from flowing, the one or more sensors 150 prevent the first and second motors 130, 132 from operating and in turn not imparting any vibration to the blade 500.

The one or more sensor assemblies 150 may be assembled as such to detect a level of tilt of the vibrating device 100 relative to a flat surface on the ground such as poured cement ready to be smoothed. The vibrating device 100 mounted to the blade 500 of the cement smoothing device will be relatively parallel with the poured cement on the ground, and the vibrating device 100 will correspond with the movement of the blade 500. When the cement smoothing device is moved forward on poured cement, the blade 500 is angled such that a back side (i.e., the side not facing the operator) of the vibrating device 100 is angled upward, or in other words tilted upward. When the cement smoothing device is moved backward on poured cement, the blade 500 is angled such that the front side (i.e., the side that faces the operator) of the vibrating device 100 is angled slightly upward. The forward movement of the cement smoothing device is a movement away from the operator's body. The backward movement of the cement smoothing device is a movement toward the operator's body. The one or more sensor assemblies 150 detect the tilt of the blade 500 and the mounted vibrating device 100 and selectively turn the first and second motors 130, 132, of the vibrating device 100 off and on. It is desired that in the forward movement, the first and second motors 130, 132, are on and in the backward movement, the first and second motors 130, 131, are off. Thus, in the forward movement, the operator desires for the vibrating device 100 to impart vibration to the blade 500 of the cement smoothing device and in the backward movement, the operator desires the vibrating device 100 to not vibrate. The one or more sensor assemblies 150 automatically adjusts the vibrating device 100 to vibrate or not vibrate based on the forward or backward movement, respectively.

Figure 7:
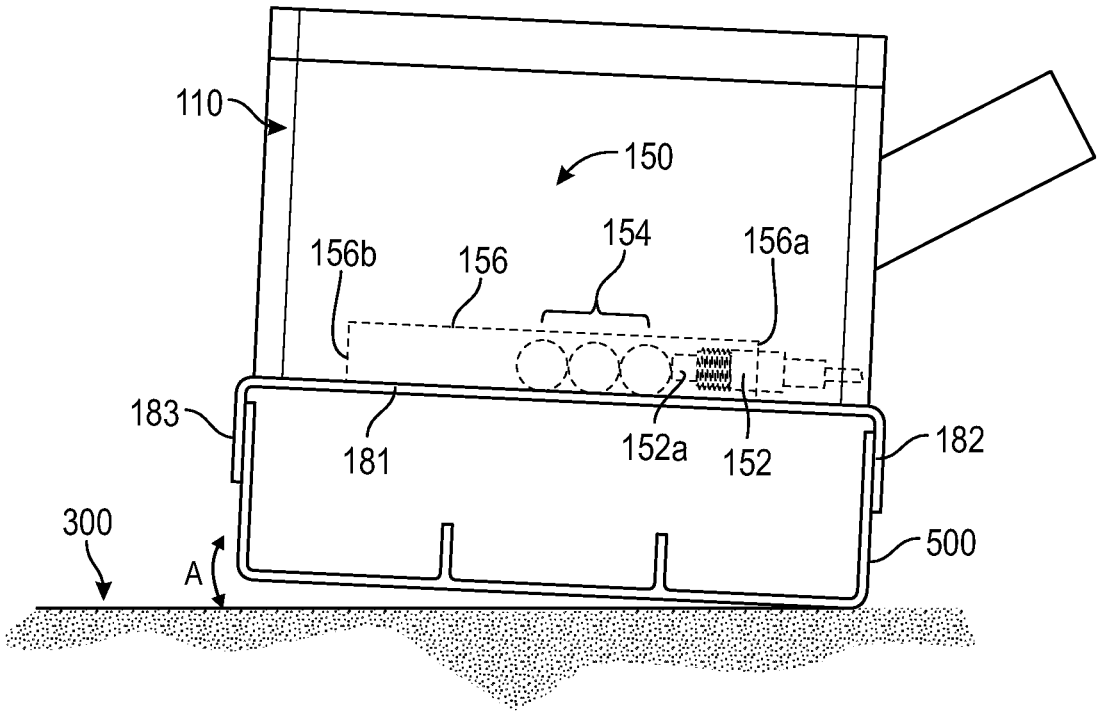
FIG. 7 is a side internal view of the housing depicting a sensor tilted in a position that engages one or more motors.
Figure 8:
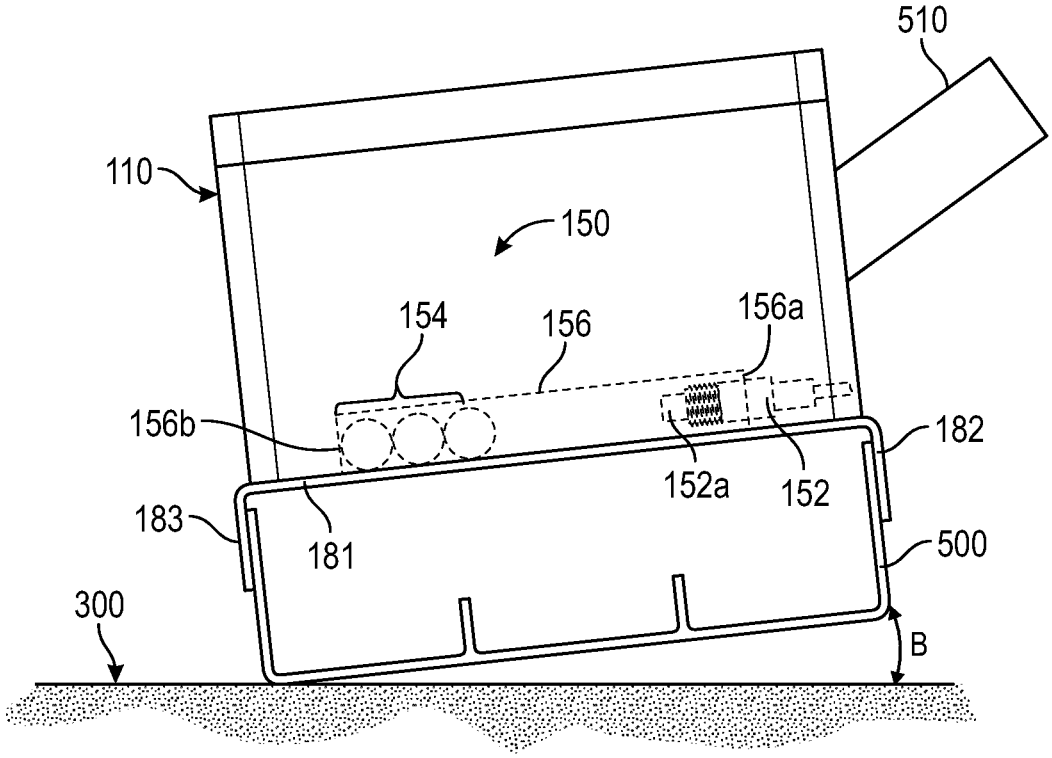
FIG. 8 is a side internal view of the housing depicting a sensor tilted in a position that disengages one or more motors.

The one or more sensor assemblies 150 may be a type of tilt sensor or a sensor assembly capable of detecting a change in angle. As shown in FIGS. 4, 7, and 8, the vibrating device 100 comprises of one sensor assembly 150 which is shown to be assembled within the second case 114. The sensor assembly 150 may alternatively be assembled in the first case 112. The sensor assembly 150 is shown to be housed within its own housing, referred to as a sensor housing 151. The sensor housing 151 may be coupled to the housing 110 (e.g., within the first case 112) with fasteners or couplers. Alternatively, the sensor assembly may be directly coupled to the housing within the first or second case 112, 114, with attachment means such as and not limited to clamps.

Still referring to the FIGS. 4, 7, and 8, the sensor assembly 150 is shown to include a sensor 152, and one or more metal balls 154 disposed within a cylindrical tube 156. The sensor 152 may be of a type that detects presence of a metal object or objects. An example of such a sensor may include and not be limited to a proximity sensor. Referencing the single sensor assembly 150 used in the illustrated embodiment, the cylindrical tube 156 has an open end 156*a* and a closed end 156*b*. The sensor 152 has a detection end 152*a* which is inserted into the open end 156*a* of the cylindrical tube 156 and the one or more metal balls 154 are disposed in the cylindrical tube 156 between the sensor 152 and the closed end 156*b*. The cylindrical tube 156 has a diameter wide enough to snugly fit the sensor 152 on the open end 156*a* and allow the one or more metal balls 154 to reciprocate within the cylindrical tube 156 as the vibrating device 100 may be tilted with the forward and backward movement of the cement smoothing device. The sensor assembly 150 is contained within the first case 112 with the sensor 152 oriented on the end facing the operator, and the closed end of the cylindrical tube 156 on the end that faces away from the operator. When the sensor 152 comes in contact with the one or more metal balls 154, the first and second motors 130, 132 are operating and imparting the vibration to the blade 500 of the cement smoothing device. When the one or more metal balls 154 reciprocate away from the sensor 152, the current is prevented from flowing to the first and second motors 130, 132, preventing their operation and vibration to the blade 500 of the cement smoothing device. Accordingly, the sensor 152 and the one or more metal balls 154 cooperate to prevent a flow of circuit to the first and second motors 130, 132. Additionally, the sensor 152 and the one or more metal balls 154 also cooperate to resume the flow of circuit to the first and second motors 130, 132 and restart operation and vibration to the blade 500 of the cement smoothing device.

As mentioned above, the sensor assembly 150 in the illustrated embodiment is assembled to detect a tilt of the blade 500 and the mounted vibrating device 100. FIGS. 7 and 8 illustrate the sensor 152, the one or more metal balls 154, and the cylindrical tube 156 from a side internal view of the vibrating device 100 mounted on the blade 500 of the cement smoothing device. The direction of the handle 510 indicates where the operator will be standing and moving the cement smoothing device forward and backward (FIG. 7 and FIG. 8, respectively). As shown in FIG. 7, when the cement smoothing device is moved forward (i.e., away from the operator), the blade 500 and the mounted vibrating device 100 are tilted upward at the back end, which is indicated as angle A relative to a flat surface of poured concrete 300. When the vibrating device 100 is tilted at angle A, the one or more metal ball 154 are resting against the sensor 152 so that the first and second motors 130, 132 (shown in FIG. 4) are powered on and imparting the vibration to the blade 500. As shown in FIG. 8, when the cement smoothing device is moved backward (i.e., toward the operator), the blade 500 and the mounted vibrating device 100 are tilted upward at the front end, which is indicated as angle B relative to the flat surface of poured concrete 300. When the vibrating device 100 is tilted at angle B, the one or more metal balls 154 reciprocate away from the sensor so that the first and second motors 130, 132 are powered off and not imparting the vibration to the blade 500. Once the cement smoothing device resumes the forward movement, the vibrating device 100 tilts at angle A and the one or more balls reciprocate back toward and rest against the sensor 152 and powering the first and second motors 130, 132 again, as in FIG. 7.

Operationally, the vibrating device 100 can selectively engage and disengage the one or more motors, such as the first and second motors 130, 132. With this embodiment, the one or more sensor assemblies 150 signal the first and second motors 130, 132 to stay on or turn off. When the operator moves the cement smoothing device forward, the first and second motors 130, 132 are powered on. When the operator moves the cement smoothing device backward, the first and second motors 130, 132 are powered off. When the first and second motors 130, 132 are powered on, the vibration is imparted to the blade 500 of the cement smoothing device facilitating the soothing of poured cement. When the first and second motors 130, 132 are powered off, the vibration is ceased and thus not imparted to the blade 500 of the cement smoothing device. The one or more sensors 150 automatically engage and disengage the power to the first and second motors 130, 132. Additionally, the operator can manually or wirelessly adjust the speed of the vibration through the speed controller 140 by using the adjustment knob 144 or an associated remote control.

Figure 9A:
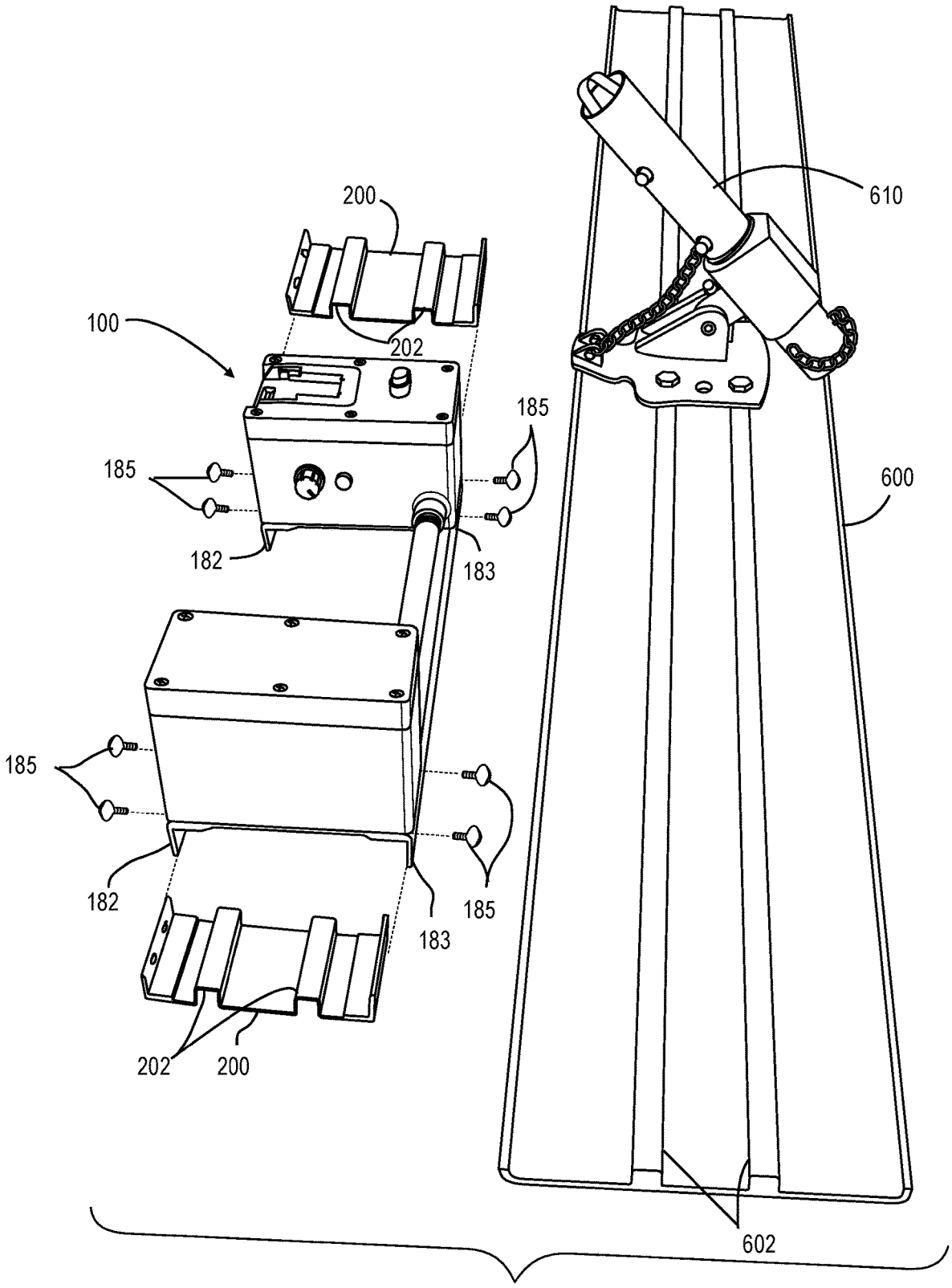
FIG. 9A is an illustration depicting an example of a bull float adaptor that may be used with the vibrating device to mount onto a blade of a bull float, a cement smoothing device.
Figure 9B:
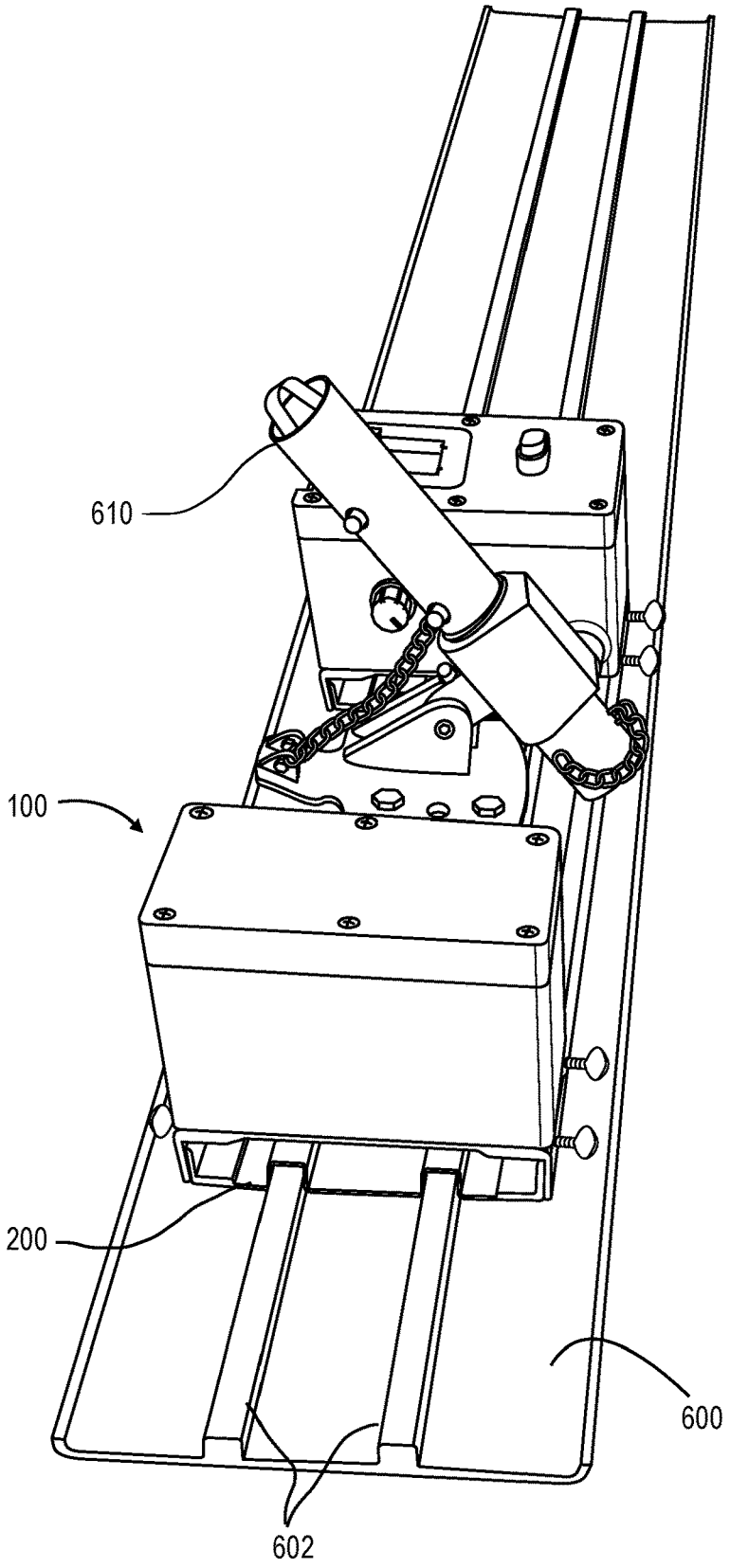
FIG. 9B is an illustration depicting the example from FIG. 9A with the bull float adaptor secured to the vibrating device and mounted onto the blade of the bull float.

FIGS. 9A, 9B, 10A, and 10B illustrate two examples of mounting the vibrating device 100 to two separate cement floating devices with different float designs. FIGS. 9A and 9B illustrate an example of a cement smoothing device that may be known as a bull float, wherein the blade 600 has a specific design and dimensions that requires a specially designed adaptor, referred to as a bull float adaptor 200, to allow the vibrating device to be mounted onto the blade 600. As seen in the Figures, the bull float adaptor 200 can fit within the mounting plate 180 of the vibrating device 100. After the bull float adaptor 200 is placed within the mounting plate 180 of the vibrating device 100, the fasteners 185 on the front edge 182 and the back edge 183 of the mounting plate 180 are inserted through the bull float adaptor 200 to secure. Once secured, the bull float adaptor 200 may be placed onto the blade 600. The blade 600 design has two raised ridges 602 and the bull float adaptor 200 is also configured with two channels 202 that complement and fit onto the raised ridges of the blade 600. Thus, the bull float adaptor 200 removably mounts the vibrating device 100 to the blade 600 without the need to drill into the blade 600. It is also contemplated that the bull float adaptor 200 may include magnets on a surface adjacent the blade 600 to hold the vibrating device 100 more securely onto the blade 600.

Figure 10A:
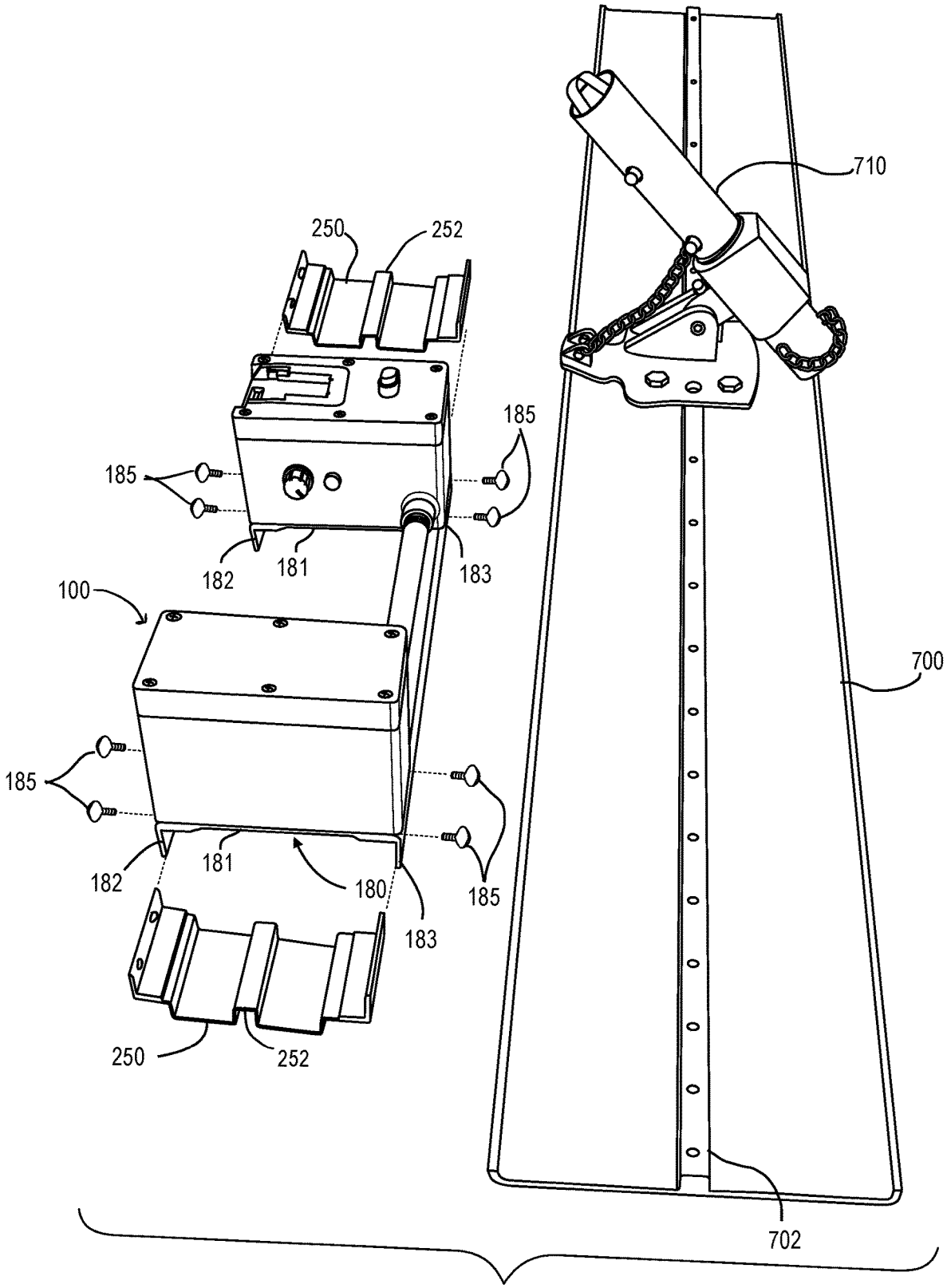
FIG. 10A is an illustration depicting an example of a fresno adaptor that may be used with the vibrating device to mount onto a blade of a fresno, a cement smoothing device.
Figure 10B:
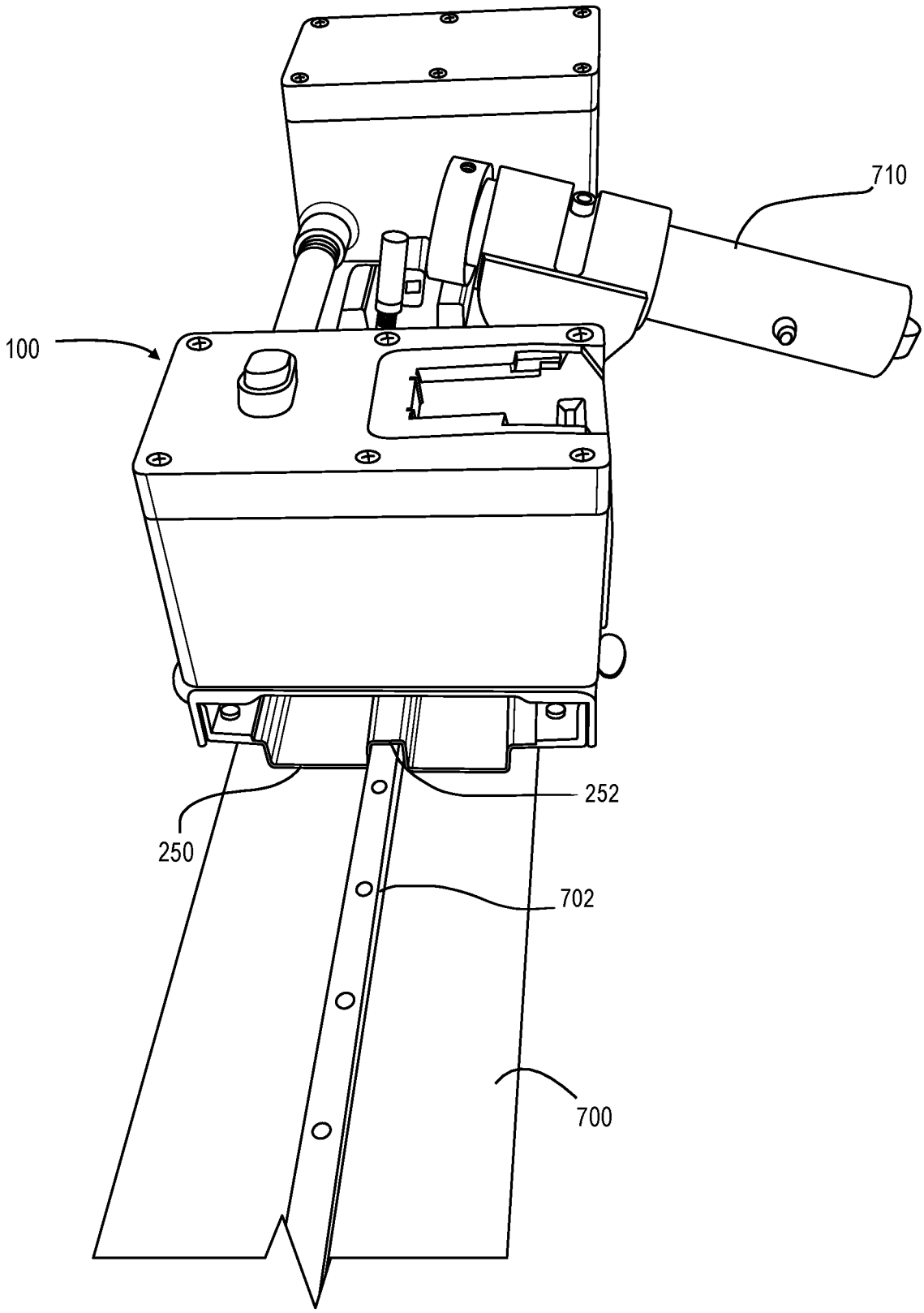
FIG. 10B is an illustration depicting the example from FIG. 10B with the fresno adaptor secured to the vibrating device and mounted onto the blade of the fresno.

FIGS. 10A and 10B illustrate an example of a cement smoothing device that may be known as a fresno, wherein the blade 700 has a specific design and dimensions that requires a specially designed adaptor, referred to as a fresno adaptor 250, to allow the vibrating device to be mounted onto the blade 700. The figures illustrate that the fresno adaptor 250 can fit within the mounting plate 180 of the vibrating device 100. After the fresno adaptor 250 is placed within the mounting plate 180 of the vibrating device 100, the fasteners 185 on the front edge 182 and the back edge 183 of the mounting plate 180 are inserted through the fresno adaptor 250 to secure. Once secured, the fresno adaptor 250 may be placed onto the blade 700. The blade 700 design has one centrally raised ridge 702 and the fresno adaptor 250 is also configured with a single channel 252 that complement and fit onto the raised ridges of the blade 700. Thus, the fresno adaptor 250 removably mounts the vibrating device 100 to the blade 700 without the need to drill into the blade 700. The fresno adaptor 250 may also include magnets on a surface adjacent the blade 700 on either side of the channel 252 to hold the vibrating device 100 more securely to the blade 700.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A vibrating device for a cement smoothing device the vibrating device comprising:

a mounting plate including components for attachment to both a cement smoothing blade and a housing, the mounting plate including a base plate having a front edge and a back edge, the front edge having a lip and the back edge having a lip extending essentially perpendicularly away from the base plate wherein the front edge lip and the back edge lip are relatively parallel to each other, wherein the base plate rests on a top surface of the cement smoothing device with the front edge lip and the back edge lip extending down to engage with a front edge and a back edge of the cement smoothing blade, respectively, and the housing attaches to a top of the mounting plate; and the housing configured to attach to the mounting plate and containing;

one or more motors configured to impart a vibration to the cement smoothing blade; and one or more sensor assemblies in electrical communication with the one or more motors to selectively engage and disengage the one or more motors.

2. The vibrating device of claim 1, wherein the mounting plate is mounted onto a top surface of the blade of the cement smoothing device.

3. The vibrating device of claim 1, wherein the mounting plate is configured to be removably secured onto a top surface of the blade without drilling into the blade.

4. The vibrating device of claim 1, wherein one or more fasteners are inserted through the back edge of the mounting plate and an end of the one or more fasteners abut against the back edge of the blade of the cement smoothing device, wherein the one or more fasteners are capable of being tightened by a hand of an operator to allow the mounting plate to securely attach to the blade.

5. The vibrating device of claim 1, wherein one or more fasteners are inserted through the front edge of the mounting plate and an end of the one or more fasteners abut against the front edge of the blade of the cement smoothing device, wherein the one or more fasteners are capable of being tightened by a hand of an operator to allow the mounting plate to securely attach to the blade.

6. The vibrating device of claim 1, wherein the housing comprises:

a first case having a first connection port and a second case having a second connection port, wherein the first case and the second case are spaced apart and are positioned to be on either side of the handle on the blade of the cement smoothing device;

a bridge tube, wherein the bridge tube matingly connects with first connection port and the second connection port to bridge the first case and the second case; and whereby the bridge tube allows wiring to pass through the bridge tube between the first case and the second case.

7. The vibrating device of claim 6, wherein the one or motors are housed within the first case and the second case to evenly impart a vibration to the blade of the cement smoothing device on either side of the handle.

8. The vibrating device of claim 1, wherein the one or more sensor assemblies is electrically connected to the one or more motors through a power relay.

9. The vibrating device of claim 1, wherein the one or more sensor assemblies is assembled to detect a level of tilt of the vibration device relative to a flat surface on the ground.

10. The vibrating device of claim 1, wherein each of the one or more sensor assemblies comprises:

a cylindrical tube having an open end and a closed end;

a sensor, wherein a detection end of the sensor is disposed within the cylindrical tube through the open end;

one or more metal balls disposed within the cylindrical tube, where in the one or more metal balls are disposed between the sensor and the closed end of the cylindrical tube;

wherein the one or more metal balls reciprocate within the cylindrical tube and cooperate with the sensor to detect a tilt of the vibrating device, whereby the sensor allows a flow of electric current through an electrical circuit to the one or more motors or prevents the flow of electric current through the electrical circuit to the one or more motors.

11. The vibrating device of claim 10, wherein the sensor allows the flow of electric current to the one or more motors when the one or more metal balls are in contact with the detection end of the sensor, and wherein the sensor prevents the flow of electric current to the one or more motors when the one or more metal balls reciprocate away from and are not in contact with the detection end of the sensor.

12. The vibrating device of claim 1, wherein the vibrating device is configured with a power dock, wherein the power dock receives a power source whereby the power source is in electrical communication with the vibrating device when the power source is connected to the vibrating device through the power dock.

13. The vibrating device of claim 1, further comprising a speed controller which is contained within the housing and is coupled to the one or more motors, wherein a speed on/off switch and a speed adjustment knob are in electrical communication with the speed controller, whereby a speed of the one or more motors is adjusted, wherein the speed controller is connected to the one or more motors by wires or connected wirelessly and having remote operation capability, whereby the speed of the one or more motors is adjusted by manually turning the speed adjustment knob or remotely through a remote control.

14. The vibrating device of claim 1, wherein one or more adaptors are configured and used to mount the vibrating device to one or more varied design and dimensioned blades of cement smoothing devices, wherein the mounting plate is secured to an adaptor configured for a specific design and dimensioned blade of a cement smoothing device.

15. A vibrating device for cement smoothing device, the vibrating device comprising:

a mounting plate including a base plate having a front edge and a back edge, the front edge having a lip and the back edge having a lip extending essentially perpendicularly away from the base plate wherein the front edge lip and the back edge lip are relatively parallel to each other, the mounting plate including components for attachment to both a housing and a cement smoothing blade; and the housing configured to attach to the base plate of the mounting plate, wherein the housing has a first case and a second case spaced apart and positioned on either side of a handle on the cement smoothing blade, wherein the first case has a first cover and the second case has a second cover, wherein each of the first cover and the second cover allows access into the first case and the second case, respectively, and further sealingly provide an enclosure, the housing containing;

a first motor contained within the first case of the housing and a second motor contained within the second case of the housing, the first and second motors configured to impart a vibration to the cement smoothing blade;

one or more sensor assemblies in electrical communication with the first and second motors to selectively engage and disengage the first and second motors;

one or more power docks configured on the housing whereby each of the one or more power docks receive a power source, wherein the power source is in electrical communication with the vibrating device when the power source is connected to the vibrating device through the one or more power docks.

16. The vibrating device of claim 15, wherein the front edge and the back edge of the mounting plate engage with a front edge and a back edge of the blade of the cement smoothing device, respectively, and the base plate rests on a top surface of the blade and wherein the mounting plate is removably secured onto the top surface of the blade without drilling into the blade.

17. The vibrating device of claim 15, the housing further comprising a bridge tube wherein the bridge tube matingly connects with a first connection port on the first case and a second connection port on the second case connecting the first case and the second case together and whereby the bridge tube allows wiring to pass through the bridge tube between the first case and the second case.

18. The vibrating device of claim 15, wherein the one or more sensor assemblies is electrically connected to the one or more motors through a power relay, and wherein the one or more sensor assemblies is assembled to detect a level of tilt of the vibration device relative to a flat surface on the ground.

19. The vibrating device of claim 15, wherein each of the one or more sensor assemblies comprises:

a cylindrical tube having an open end and a closed end;

a sensor, wherein a detection end of the sensor is disposed within the cylindrical tube through the open end;

one or more metal ball disposed within the cylindrical tube, where in the one or more metal balls are disposed between the sensor and the closed end of the cylindrical tube;

wherein the one or more metal balls reciprocate within the cylindrical tube and cooperate with the sensor to detect the tilt of the vibrating device, whereby the sensor allows a flow of electric current through an electrical circuit to the one or more motors or prevents the flow of electric current through the electrical circuit to the one or more motors.

20. The vibrating device of claim 19, wherein the sensor allows the flow of electric current to the one or more motors when the one or more metal balls are in contact with the detection end of the sensor, and wherein the sensor prevents the flow of electric current to the one or more motors when the one or more metal balls reciprocate away from and are not in contact with the detection end of the sensor.

21. The vibrating device of claim 15, further comprising a speed controller which is contained within the housing and is coupled to the one or more motors, wherein a speed on/off switch and a speed adjustment knob are in electrical communication with the speed controller, whereby a speed of the one or more motors is adjusted, wherein the speed controller is connected to the one or more motors by wires or connected wirelessly and having remote operation capability, whereby the speed of the one or more motors is adjusted by manually turning the speed adjustment knob or remotely through a remote control.

22. The vibrating device of claim 15, wherein one or more adaptors are configured and used to mount the vibrating device to one or more varied design and dimensioned blades of cement smoothing devices, wherein the mounting plate is secured to an adaptor configured for a specific design and dimensioned blade of a cement smoothing device.

* * * * *